United States Patent [19]

St. Louis

[11] Patent Number: 4,994,654

[45] Date of Patent: Feb. 19, 1991

[54] HEATER COIL MOUNTING FOR A DRYER

[75] Inventor: Robert M. St. Louis, St. Leonard, Canada

[73] Assignee: Camco Inc., Mississauga, Canada

[21] Appl. No.: 413,151

[22] Filed: Sep. 27, 1989

[30] Foreign Application Priority Data

Dec. 1, 1988 [CA] Canada ..... 584731

[51] Int. Cl.[5] ..... H05B 3/06

[52] U.S. Cl. ..... 219/532

[58] Field of Search ..... 219/532, 542; 174/138 J

[56] References Cited

U.S. PATENT DOCUMENTS

| | | | |
|---|---|---|---|
| 3,920,887 | 11/1975 | Kloos et al. | 219/532 |
| 3,943,333 | 3/1976 | Kokjohn | 219/532 |
| 3,963,859 | 6/1976 | Petersen et al. | 219/532 |
| 3,967,094 | 6/1976 | Petersen et al. . | |
| 4,289,955 | 9/1981 | Seeley | 219/532 |
| 4,656,340 | 4/1987 | St. Louis . | |

FOREIGN PATENT DOCUMENTS

| | | | |
|---|---|---|---|
| 771787 | 12/1966 | Canada | 219/532 |
| 889457 | 12/1971 | Canada | 219/532 |
| 1017786 | 9/1977 | Canada | 219/532 |

*Primary Examiner*—Roy N. Envall, Jr.

[57] ABSTRACT

A support bracket and a method for mounting a heating coil in a dryer or the like by means of such bracket is disclosed. The support bracket is a plate of unitary construction having one or more openings for receiving and supporting an insulating bushing and a pair of support legs adapted for engagement with slots in a support wall. At least one portion of the plate is folded upon itself to form a retaining rim for the bushing and reinforcing the support legs.

9 Claims, 2 Drawing Sheets

HEATER COIL MOUNTING FOR A DRYER

FIELD OF THE INVENTION

This invention relates to a heater coil mounting assembly for a dryer or the like. More particularly, it relates to a bracket plate having insulating bushings therein for securing a heater coil within a mounting assembly.

BACKGROUND OF THE INVENTION

Various types of mounting brackets have been constructed in the past to support heater coils within an electric heater or clothes dryer. In such brackets, the heater coils pass through ceramic grommets or other types of insulating bushings retained in brackets and then the brackets are mounted on a retaining wall. Such brackets attempted to provide a simple, efficient and cost effective way of securing the insulating bushings and for mounting the coils to the retaining wall.

It must be appreciated that to be cost efficient, the mounting bracket should be simple to construct and should be capable of being quickly secured and released without special tools. In this respect, attempts in the prior art to provide such a mounting bracket met with varying degrees of success.

For example, Canadian patent No. 771,787 of Kinney issued Nov. 14, 1967 describes a mounting assembly to be inserted into a pipe encasement. The assembly includes special ceramic insulators having a dove-tail base that is retained in a mounting strip and secured by means of jaws or clips that are then spot welded onto the mounting strip. This mounting assembly requires a special ceramic insulator and several interacting pieces as well as a welding step during installation.

Canadian patent No. 889,457 of Fox issued Dec. 28, 1971 describes a mounting assembly consisting of a series of lanced tabs bent out of the reflector pan or support wall of the dryer. Insulator bushings are mounted on these tabs by means of a resilient clip which are held in place by a tongue in the clip that locks into an aperture in the bent out tab. This requires a unique type of insulator bushing and an intricately formed clip.

Canadian patent No. 1,017,786 of Wightman et al issued Sept. 20, 1977 discloses a rather complicated and relatively expensive means for securing a heater coil to a specially designed insulator. The insulator is held to a support structure by means of a projection that extends through an aperture in the insulator. A metal clip holds the heating coil onto the insulator.

U.S. Pat. No. 4,656,340 of the present inventor issued Apr. 7, 1987 discloses a bracket plate which is bent along its longitudinal axis to form a U-shaped support for a pair of insulator bushings. The support and bushings are secured into position by cooperating tabs that project from the heater wall. While this mounting is an improvement in the art, in that a single support plate is used to secure the bushings, it requires several complicated manipulative steps. The simplification of the steps required for carrying out the present invention will be described below. These reduce the manufacturing and repair costs of the dryer or heater.

U.S. Pat. No. 3,967,094 of Petersen et al issued June 29, 1976 discloses a support member for insulator bushings. Two cooperating strips having cut-outs for seating the bushings are positioned in lapping relationship so that the folded edge of one strip is locked in engagement with the folded edge of the other. One inherent limitation of this design is that all the bushings are lined up in side by side or parallel relationship, since each end of a strip is secured to a side wall of the heater frame. This allows only an up and down arrangement of the heater coil. It would not permit the arrangement of heater coils along the parameter of a drum such as is required in a clothes dryer.

SUMMARY OF THE INVENTION

The present invention provides for an improved heating coil mounting assembly for a dryer or the like which uses a support bracket formed from an integral plate which is partially folded onto itself to secure insulating bushings positioned therethrough and is also folded to provide extension legs for securing the bracket in an upright position through slots in a support wall.

It is therefore an object of one aspect of this invention to provide a support bracket for a heating coil mounting assembly which is relatively simple and economical to construct.

It is the object of another aspect of the invention to provide a support bracket for a heating coil made from a plate of unitary construction.

These and other objects of the invention are provided by a support bracket for a heating coil mounting assembly comprising: a plate of unitary construction having at least one opening therethrough for receiving and supporting an insulating bushing; a pair of integral support legs at one end of said plate and adapted for engagement within cooperating slots in a support member to retain said plate perpendicular to said member; at least one section of said plate being folded upon itself to form a retaining rim for said insulating bushing.

It is an object of another aspect of the invention to provide a relatively simple method of mounting a heating coil within a heater unit.

This object is provided by a method of mounting a heating coil within a heater unit comprising: passing a heating coil through a plurality of insulating bushings, each of said bushings being mounted in the opening of a plate of unitary construction, said plate defining a support bracket; connecting the ends of said heating coil to electrical terminals within said heater unit; arranging the plurality of said support brackets around the parameter of a support wall in said heater unit to overlie in axial alignment with corresponding slots in said support wall; engaging integral support legs on each said support bracket in said corresponding slots; and, torsioning the portion of each of said legs engaged within said slots for securing said support bracket in upright engagement on said support wall.

DETAILED DESCRIPTION OF THE PREFERRED EMBODIMENT

Figure 1:
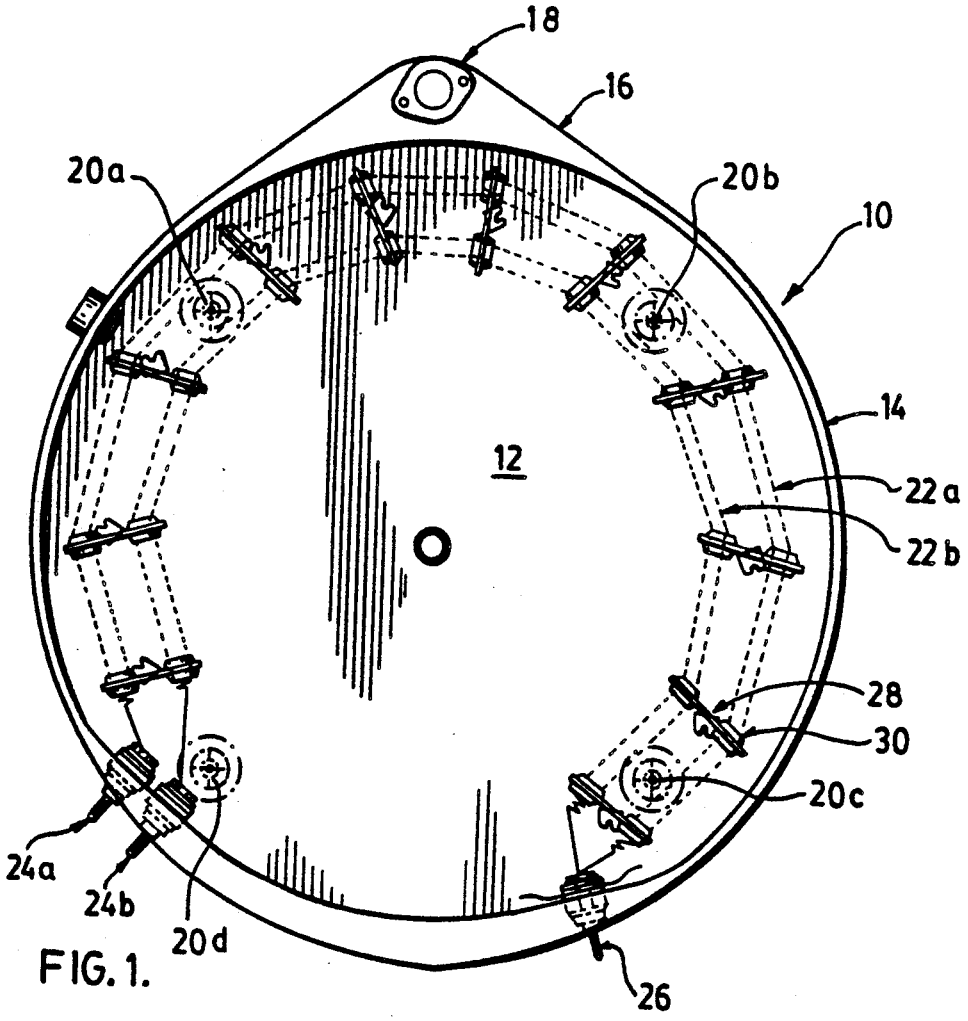
FIG. 1 is an elevation view showing the positioning of heating elements around the parameter of a dryer support wall.

In FIG. 1, a cylindrical type heater such as used in a clothes dryer is shown generally at 10. The heater has a support wall 12 with a peripheral rim 14 extending around its edges. Rim 14 widens to an extended lip 16 having an opening 18 for securing a thermostat to the heater assembly. In the embodiment shown in FIG. 1 four securing bolts 20*a,b,c* and *d* respectively, are shown for further retaining the heater in place. A pair of heater coils 22*a* and 22*b* respectively, extend around the parameter of support wall 12. One end of each of the coils is connected to a power source via terminals 24*a* and 24*b* respectively, and the other end is connected to a common terminal 26.

Heater coils 22*a* and 22*b* are retained in position by a series of support brackets 28 that are secured to the support wall 12 in a manner to be described below. Each coil passes through an insulating bushing 30 mounted in an opening in bracket 28.

Figure 2:
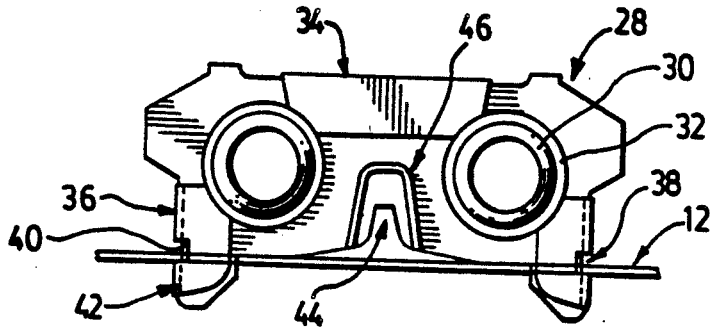
FIG. 2 is s a front elevation view of a support bracket of the present invention mounted on a support wall.

A bracket 28 is shown generally in FIG. 2 as being mounted on support wall 12. A pair of insulating bushings 30 are located within openings 32 in the bracket plate. These bushings are held in position by a retaining rim 34 at the upper end of the bracket which is formed by folding down a projecting portion of the top edge of the metal bracket plate in a manner to be explained below. It must be appreciated that the bracket can be constructed with a single opening for supporting a single insulating bushing should this be preferred.

A pair of legs 36 are formed at each side of the bracket plate. The leg strength is reinforced by the folding back of the side projections of the metal bracket plate upon themselves to define the contour of the legs. In the embodiment shown in FIG. 2, such fold back also provides additional securing means for the insulating bushings. In this embodiment of the invention, a notch 38 is formed in the folded back contour of each of the legs 36. When the legs are fitted into slots 40 of support wall 12, bracket 28 is supported upright on wall 12 as shown in FIG. 2, and the bracket is locked into position by twisting or torsioning the projecting end 42 of the legs 36 with pliers or automatic equipment. Thus, separate fasteners are not required to secure the insulating bushings or mount the brackets, and no special skills or tools are needed for factory installation.

Figure 3:
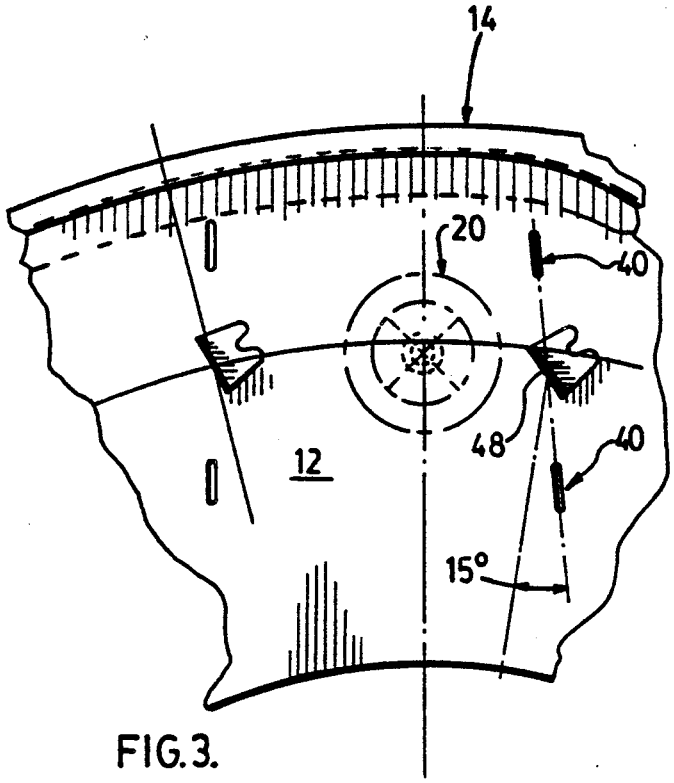
FIG. 3 Is a schematic plan view of the support wall illustrating the position of the slits and reinforcing tabs; and, FIG. 4 is a plan view of a plate cut-out in the pattern for holding the support bracket of FIG. 2.

Support bracket 28 is also provided with a central support groove 44 extending from its lower end and may have an indented reinforcing ridge 46. In one embodiment of this invention the bracket 28 may be further supported in a rigid upright position by the aid of a two-pronged tab 48 (FIG. 3), which is cut from support wall 12 and bent upright perpendicular to the wall as shown in FIG. 3. While the mounting in FIG. 2 does not include a reinforcing tab 48, in the embodiment in which such tab is used, the support groove 44 is fitted between the prongs of tab 48 when legs 36 are inserted into their respective slots in support wall 12.

In the case where such tabs are used, the positioning of the tab with respect to the axial alignment of the cooperating slots is shown with particular reference to FIG. 3.

In the preferred embodiment of the invention, the support brackets are radially aligned along the parameter of the support 12 in a position slightly off set from the radius of the cylindrical heater wall. This is to allow for approximate straight line extension of the parallel heater coils from one support bracket to another. As shown in FIG. 3, the pair of slots 40 are angled at approximately 15° from the radius of the wall. It must be appreciated that this off set alignment is to allow for more efficient use of heater coil length so that a pair of heater coils will be substantially parallel between each pair of support brackets. Also, this angle provides a retaining or skewed effect which prevent the coils from sliding through the insulating bushings when the heater assembly is in a vertical position. The hot and cold temperature fluctuations of the coil as the heater is turned on and off tends to make the coil creep down through the bushings and eventually sag at the lowest point.

In the embodiment wherein a two-pronged tab 48 is used to reinforce the bracket in an upright position, the tab is projected at substantially right angles from support wall 12. In the particular embodiment shown, the base of the projecting tab is at an angle of approximately 30° from the axis between the pair of slots 40. This is to allow the support groove 44 in bracket 28 to fit between the upwardly projecting prongs of tab 48 when the legs are in slots 40.

The advantages of the support bracket of the present invention can be found in the simplicity and economy of the unitary construction. It can be manufactured from a single blank or coil and fitted into preformed cuts in the heater support wall. No additional fasteners or interlocking pieces are necessary. In this respect, FIG. 4 shows a blank of galvanized metal, cut from a single die or formed from the continuous flow of a progressive die, that can be made into a support bracket of the type shown in FIG. 2.

Figure 4:
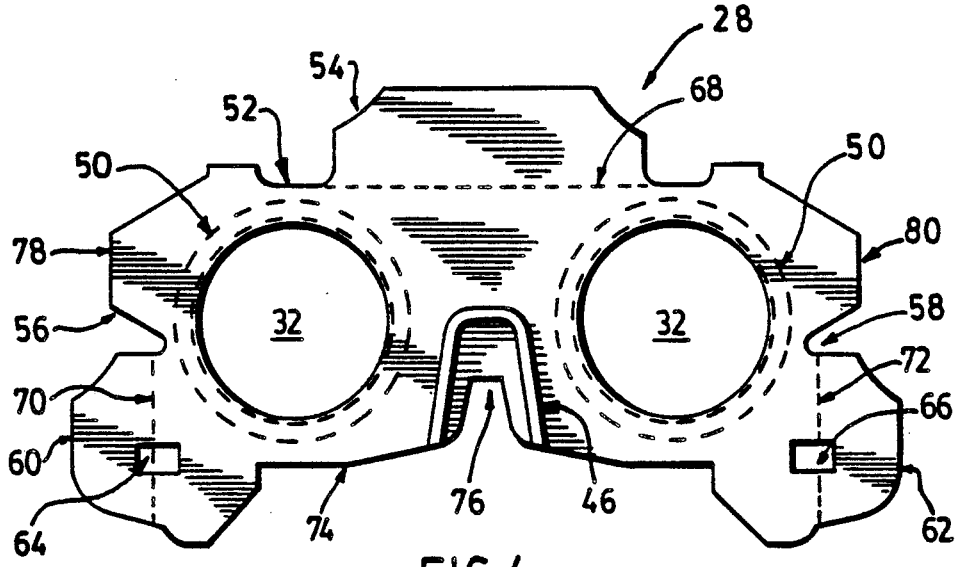

Support bracket plate shown generally at 28 in FIG. 4, consists of a metal plate having a pair of openings 32 for fitting and securing a pair of insulating bushings. When such bushings are fitted through openings 32, their outer rim extends over the plate surface to an area defined by the broken circumferential lines 50. The top edge 52 of the plate includes a projection 54. Side walls 56 and 58 includes side projections 60 and 62. The purpose of the rectangular openings 64 and 66 in the side projections will be explained below.

When insulating bushings are fitted into openings 32, upper projection 54 in bent or folded down along broken line 68 so that the leading edge of projection 54 overlies the outer extension of the bushings. Similarly, side projections 60 and 62 are folded down along broken lines 70 and 72 respectively, so that their leading edges overlie the outer extension of the respective left side and right side bushings. The fold-down of projections 60 and 62 also provides the legs 42 shown in FIG. 2. When projections 60 and 62 are folded along lines 70 and 72 that pass approximately through the center of rectangular openings 64 and 66, these openings form notches 38 that can be seen in FIG. 2. Notch 38 in each leg permits the twisting or torsioning of the leg extensions in the support wall slots without distorting the bracket itself when the support bracket 28 is mounted in heater support wall 12.

In the embodiment shown in FIG. 4, the plate lower edge 74 includes a centrally located indentation 76. This provides the support groove 44 of in FIG. 2. The plate may also be indented in this area to provide a reinforcing ridge 46. In yet a further embodiment, upper side projections 78 and 80 may also be folded down to overlie the outer extension of the bushings in openings 32 to provide additional security.

When a pair of heater coils are to be installed in a cylindrical heater 10, coils 22*a* and 22*b* are threaded through the bushings which are held within the openings of a series of support brackets 28. The ends of the coils are connected to electrical terminals 24*a* and 24*b* at one end and terminal 26 at the other for hook up to a 120/240 volt system. Brackets 28 are arranged around the parameter of the heater support wall 12 and aligned with pre-cut slots which, as indicated previously with reference to FIG. 3, are angled from the radius of the cylindrical wall. The brackets are axially aligned with their corresponding slots and the ends of bracket legs 42 inserted therein. In the embodiment wherein the support wall 12 also includes a cut-out tab 48, support groove 44 is mounted between the prongs of the respective tab to further support the bracket in the upright position. The bracket is then locked into position by twisting the portion of legs 42 that extend through the slots by means of pliers or other tools. The lower edges of notches 38 provide a locking effect when legs are twisted as they project through wall 12.

Certain preferred embodiments of the invention have been described in detail. From a reading of this disclosure, obvious modifications will be evident to those skilled in the art without departing from the spirit of the invention disclosed or from the scope of the appended claims.

What I claim as new and desire to secure by Letters Patent of the U.S. is:

1. A support bracket for a heating coil mounting assembly comprising: a plate of unitary construction having at least one opening therethrough for receiving and supporting an insulating bushing; a pair of integral support legs at one end of said plate and adapted for engagement within cooperating slots in a support member to retain said plate perpendicular to said member; at least one section of said plate being folded upon itself to form a retaining rim for said insulating bushing.

2. A support bracket as claimed in claim 1 having two openings therethrough, each for receiving and supporting an insulating bushing.

3. A support bracket as claimed in claim 2 wherein each of said legs includes a section of plate folded upon itself to provide reinforcement thereof.

4. A support bracket as claimed in claim 3 wherein said section also forms a retaining rim for at least one said insulating bushing.

5. A support bracket as claimed in claims 1, 3 or 4 which includes a section at the end of said plate remote from said legs, said section being folded upon itself to form a retaining rim for said insulating bushing.

6. A support bracket for a heating coil mounting assembly comprising: a plate of unitary construction having at least one opening therethrough for receiving and supporting an insulating bushing; a pair of integral support legs at one end of said plate adapted for engagement within cooperating slots in a support member for the upright mounting of said plate on said member; each of said legs including a section of plate folded upon itself to provide reinforcement thereof; a further section at the upper end of said plate remote from said legs, said further section being folded upon itself to form a retaining rim for said insulating bushing; and a groove at the lower end of said plate between said pair of integral support legs adapted for engagement with an upright tab on said support member during the engagement of said support legs within said cooperating slots.

7. A support bracket as claimed in claim 6 having two openings therethrough, each for receiving and supporting an insulating bushing.

8. A support bracket as claimed in claim 7 wherein said section of plate folded upon itself in each of said legs provides a further retaining rim for one said bushing as well as said reinforcement.

9. A support bracket as claimed in claim 8 wherein each of said legs further includes a notch on its outer edge in the area of engagement with said cooperating slots whereby the portion of said legs engaged within said slots may be torsioned without deforming the planar contour of the remainder of the plate.

* * * * *